United States Patent [19]

Anderson et al.

[11] 3,989,905

[45] Nov. 2, 1976

[54] MICROPHONE

[75] Inventors: C. Roger Anderson, Wilmette; Eduard A. Rusch, Bloomingdale; Charles E. Seeler, Evanston, all of Ill.

[73] Assignee: Shure Brothers Inc., Evanston, Ill.

[22] Filed: Dec. 15, 1975

[21] Appl. No.: 640,580

[52] U.S. Cl. ..... 179/121 R; 179/121 D; 179/179

[51] Int. Cl.[2] ..... H04R 1/02; H04R 1/32

[58] Field of Search ..... 179/121 R, 121 D, 179, 179/146 R, 184, 180

*Primary Examiner*—George G. Stellar
*Attorney, Agent, or Firm*—Allegretti, Newitt, Witcoff & McAndrews

[57] ABSTRACT

The disclosure describes improved apparatus for adjusting a unidirectional microphone in order to reduce the electrical output due to mechanical shocks applied to the microphone casing. The microphone includes a diaphragm supported by a housing which is resiliently mounted on the casing. The adjustment apparatus includes a mounting diaphragm positioned between the outer casing and the housing, and an enclosed chamber provided with an air leak which can alter the compliance and resistance of the mounting diaphragm in a controlled manner. A method of balancing the size or value of the elements of the microphone to provide pneumatic shock cancellation is also described.

15 Claims, 3 Drawing Figures

MICROPHONE

BACKGROUND AND SUMMARY OF THE INVENTION

This invention relates to microphones and more particularly relates to apparatus for reducing the response of a microphone due to mechanical shock.

Microphones which utilize a pneumatic pumping chamber in order to reduce the output of the microphone in response to mechanical shock have been devised in the past. One such microphone is described in U.S. Pat. No. 3,240,883 (Seeler — Mar. 15, 1966). Microphones of the type described in the Seeler patent have been marketed under the tradename "Unidyne III" by Shure Brothers Incorporated, Evanston, Ill., since the early 1960's.

Referring to the Unidyne III microphone shown in FIG. 1 of U.S. Pat. No. 3,240,883, normal output occurs when sound pressure waves impinge on the front of a diaphragm 21 and exert a force. The sound waves also impinge on the rear of the diaphragm finding access thereto through sound entry 40, screen 39, passage 30 and apertures 41. The rear of the diaphragm, the housing 9, pole piece 14 and related components form a diaphragm chamber located to the rear of the diaphragm. The time delay and the delay in the acoustic network comprising apertures 41 and resistance ring 22 cause the force on the front of diaphragm 21 to be in advance of the force on the back of diaphragm 21. The force differential between the front and back of diaphragm 21 creates a net force which moves diaphragm 21 and an attached voice coil 20 in a magnetic air gap 16. If voice coil 20 does not move relative to gap 16, no output is produced.

This effect is used in two ways in the Unidyne III:

First, the microphone is made less responsive to sources of sound behind it than in front of it. If sound pressure from a source behind the microphone occurs and the delay in the internal acoustic network is equal to the external time delay between the rear sound entry and the front sound entry, the forces on each side of the diaphragm will be exactly in step and equal. Since they are in opposite directions, these forces will cancel each other, thereby reducing the output of the microphone.

Second, the microphone is made less responsive to axial mechanical vibrations. If axial mechanical vibrations arising from floor vibrations or handling shocks were transmitted freely to pole pieces 15, 18 of cartridge 10, the diaphragm-voice coil assembly 21, 20 would vibrate relative to magnetic air gap 16 like a weight suspended from a spring at a first resonant frequency. This would produce an undesirable output, and the microphone would be "vibration sensitive."

The situation is improved in the Unidyne III by placing a compliant support mounting, such as shock mount ring 25, between cartridge 10 and outer case 9. The effective mass of cartridge 10 and the compliance of ring 25 is designed to form a mechanical resonance at a second resonant frequency lower than the microphone frequency response range of interest. In addition, the second resonant frequency of the cartridge-outer case combination 9, 10 is placed lower in frequency (or pitch) than the first resonant frequency of the diaphragm-coil assembly 21, 20 so that shock-induced output at the first resonant frequency is reduced. However, the output at the second resonant frequency would continue to be troublesome if not corrected.

In the Unidyne III structure, the output at the second resonant frequency is reduced by the pressure changes generated in cavities 44 and 45. Shock mount ring 26 causes the volume of cavities 44 and 45 to change only in response to the component of accelerations impressed on case 9 normal to diaphragm 21. The volume of cavities 44 and 45 changes in the same direction as the diaphragm chamber and produces corresponding changes of pressure in cavities 44 and 45. These pressure changes are communicated to the rear surface of diaphragm 21 through an acoustic network including holes 46, the apertures in a pressure plate 33, a cloth washer 32, apertures 31, felt pad 30, cloth screen 28, passages 29, and air gap 16. The force produced by this pressure reduces the motion of voice coil 20 relative to magnetic air gap 16 and reduces the output due to axial vibration or shock.

In greater detail, the action is as follows:

Assume a shock force is applied to the left to outer casing 9 as shown in FIG. 1. In response to the shock force, outer casing 9 moves to the left. Some of the shock force is transmitted through resilient mountings 25, 26 to the cartridge 10 which, in turn, moves to the left. In addition, a further small fraction of the force is communicated to voice coil 20 through the flexible edge of diaphragm 21. Meanwhile, the inertia of cartridge 10 causes it to lag behind the movement of housing 9. This relative motion causes the cavities 44, 45 to be reduced in volume and, consequently, to slightly compress the air in the cavities. The increased pressure due to the air compression in cavities 44, 45 is communicated through the above-described acoustic network, and a fraction of the pressure is applied to the back of diaphragm 21. When the shock force is applied to the voice coil 20 through the flexible edge of diaphragm 21, the inertia of the voice coil causes its motion to tend to lag behind the motion of cartridge 10 and to create output due to relative motion. However, the force due to the pressure on the back of diaphragm 21 moves the diaphragm and voice coil to the left in step with the motion of cartridge 10 and magnetic air gap 16. As a result, a reduced output may be produced from voice coil 20 and magnetic air gap 16 in response to an axial mechanical shock.

A later shock-compensating microphone identical in principle to the above-described Unidyne III microphone is illustrated in U.S. Pat. No. 3,766,333 (Watson — Oct. 16, 1973). Microphones of the type described in the Seeler and Watson patents are capable of shock cancellation in theory, but experience has shown that the principles described in these patents are difficult to apply in practice. The principal defect in these designs is their inability to provide uniform shock cancellation from one microphone to the next when the microphones are manufactured on an assembly line basis. It has been discovered that microphones capable of providing uniform shock cancellation can be produced by designing and balancing certain components inside the microphone according to the techniques described herein.

One feature of the invention contemplates the use of a microphone including an acoustical diaphragm having a first side and a second side with an effective area AD. The diaphragm vibrates in response to sound waves striking its surface. A voice coil having a mass MC is suspended on the diaphragm. A transducer having a mass MT converts the vibration of the diaphragm and voice coil into corresponding electrical signals. The transducer includes a housing for supporting the diaphragm in relationship to the transducer. An acoustical network having a complex acoustical impedance Z2 is coupled to the diaphragm. The acoustical network includes a variable volume cavity, a first channel having an acoustic resistance RB for couplng the variable volume cavity to the rear of the diaphragm and a second channel having a resistance RS for coupling the rear of the diaphragm to the atmosphere. The housing is supported within and resiliently coupled to an outer casing by a mounting assembly having a complex mechanical impedance of Z1 and an effective area AM.

If a shock force is applied to the outer casing in a direction parallel to the longitudinal axis of the microphone, the mounting assembly creates a pressure in the variable volume cavity which urges the diaphragm in a direction which tends to oppose the movement of the diaphragm due to the application of the shock force. As a result, the output of microphone due to the shock force is minimized.

It has been discovered that the shock sensitivity of a microphone of the foregoing type can be drastically reduced over a broad predetermined range of frequencies if the microphone components are designed to as nearly as possible achieve the balance condition defined by the equation:

$$1 + \frac{MT}{MC} = \left(1 + \frac{Z1}{(AM)^2(Z2)}\right)\left(1 + \frac{RS}{RB}\right)\left(\frac{AD}{AM}\right)$$

and if impedance Z1 is adjusted relative to impedance Z2 so that the ratio $$\frac{Z1}{(AM)^2(Z2)}$$

remains as nearly constant as possible over the predetermined frequency range and so that the phase angle of impedance Z1 and the phase angle of impedance $(AM)^2(Z2)$ are as nearly equal as possible.

According to another feature of the invention, the mounting assembly comprises an adjustable element which, in a preferred form includes a mounting diaphragm having a first side and a second side extending between the outer casing and the housing and an enclosed chamber defined in part by the second side of the mounting diaphragm. The enclosed chamber can be fitted with an adjustable air leak from the chamber to the atmosphere. By adjusting the volume of the chamber and the resistance of the air leak, the complex impedance of $Z1$ may be made to more nearly satisfy the above equation.

By using the foregoing techniques, it is possible to manufacture microphones with a degree of broad band shock cancellation uniformity previously unattainable.

DESCRIPTION OF THE DRAWINGS

These and additional advantages and features of the present invention will be described in connection with the accompanying drawings, wherein like numbers refer to like parts throughout and wherein.

DESCRIPTION OF THE PREFERRED EMBODIMENT

Figure 2:
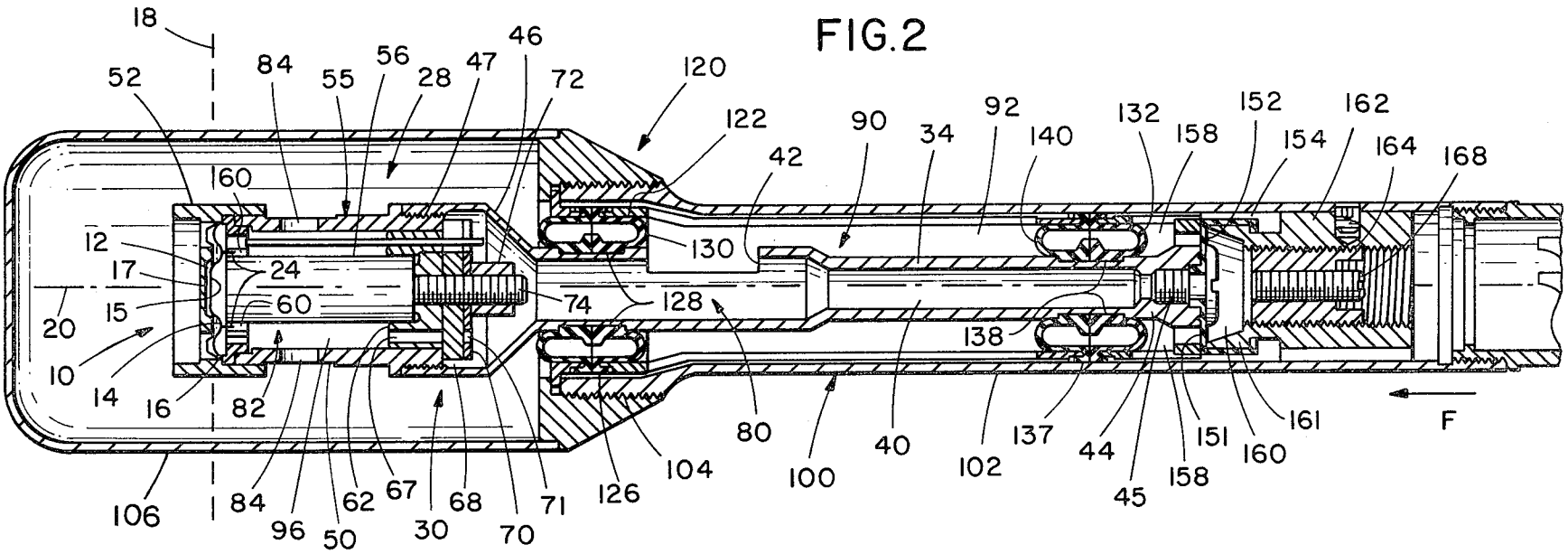
FIG. 2 is an enlarged, cross-sectional, partially fragmentary view of the microphone shown in FIG. 1.
Figure 1:
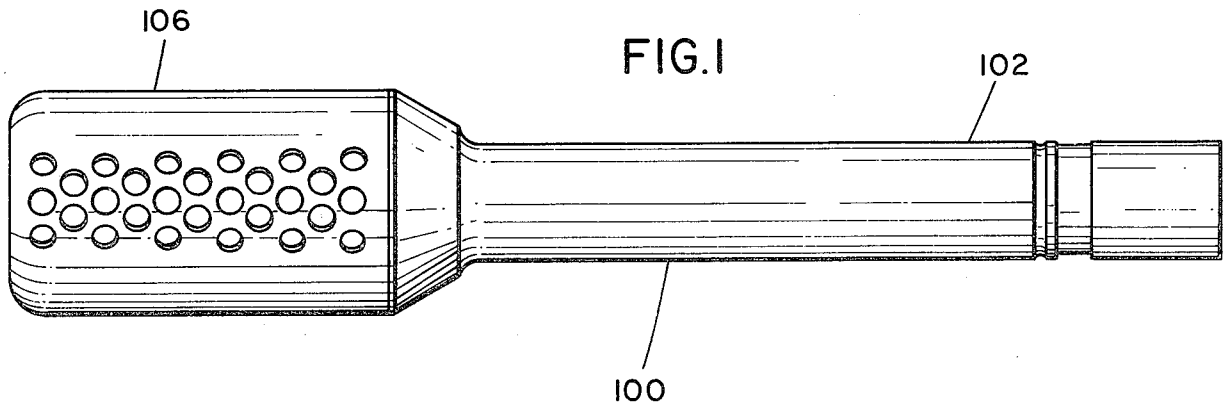
FIG. 1 is a side elevational view of a preferred form of microphone made in accordance with the present invention.

Referring to the drawings, a preferred form of microphone made in accordance with the present invention basically comprises an acoustic diaphragm assembly 10, a voice coil 24, a transducer assembly 28, and acoustical network 80, an outer casing 100, and a mounting assembly 120.

Acoustic diaphragm assembly 10 comprises an acoustic diaphragm 12 having a front side 14 and a rear side 15. Side 15 has an effective area AD which extends to a circular perimeter 16. Diaphragm 12 has a center point 17 through which a tangent plane 18 may pass. A longitudinal axis 20 perpendicular to plane 18 passes through a center point 17.

A conventional voice coil 24 having a mass MC is cemented to side 15 of diaphragm 12. Diaphragm 12 is made of a thin, flexible material which vibrates in accordance with the sound waves striking the diaphragm.

Transducer assembly 28 has a mass MT and basically comprises a housing 30 which positions diaphragm 12 in relationship to the various magnetic and structural elements of assembly 28 and a magnetic assembly 55 which converts the vibrations of voice coil 24 into electrical signals.

Housing 30 comprises a hollow metal stem 34 having circular recesses 37, 38 (FIG. 3) and an interior cavity 40 to which access is provided by a port 42. Stem 34 terminates at its rear end in a threaded bore 44 which receives a mounting screw 45. Stem 34 terminates at its front end in a flared section 46 which is cut with internal threads 47 which receive a cylindrical shell 50. Shell 50 is completed at its front end by an acoustically permeable head piece 52 which is substantially cylindrical and which carries a fibrous screen 54 (FIG. 3) for direct entry of acoustic vibrations or sound waves to the microphone transducer. The rear surface of head piece 52 forms a protective, perforated resonator plate 64 (FIG. 3) mounted substantially parallel to diaphragm 12 and radially of the transducer assembly. Resonator plate 64 is provided with a plurality of holes 65 (FIG. 3).

Figure 3:
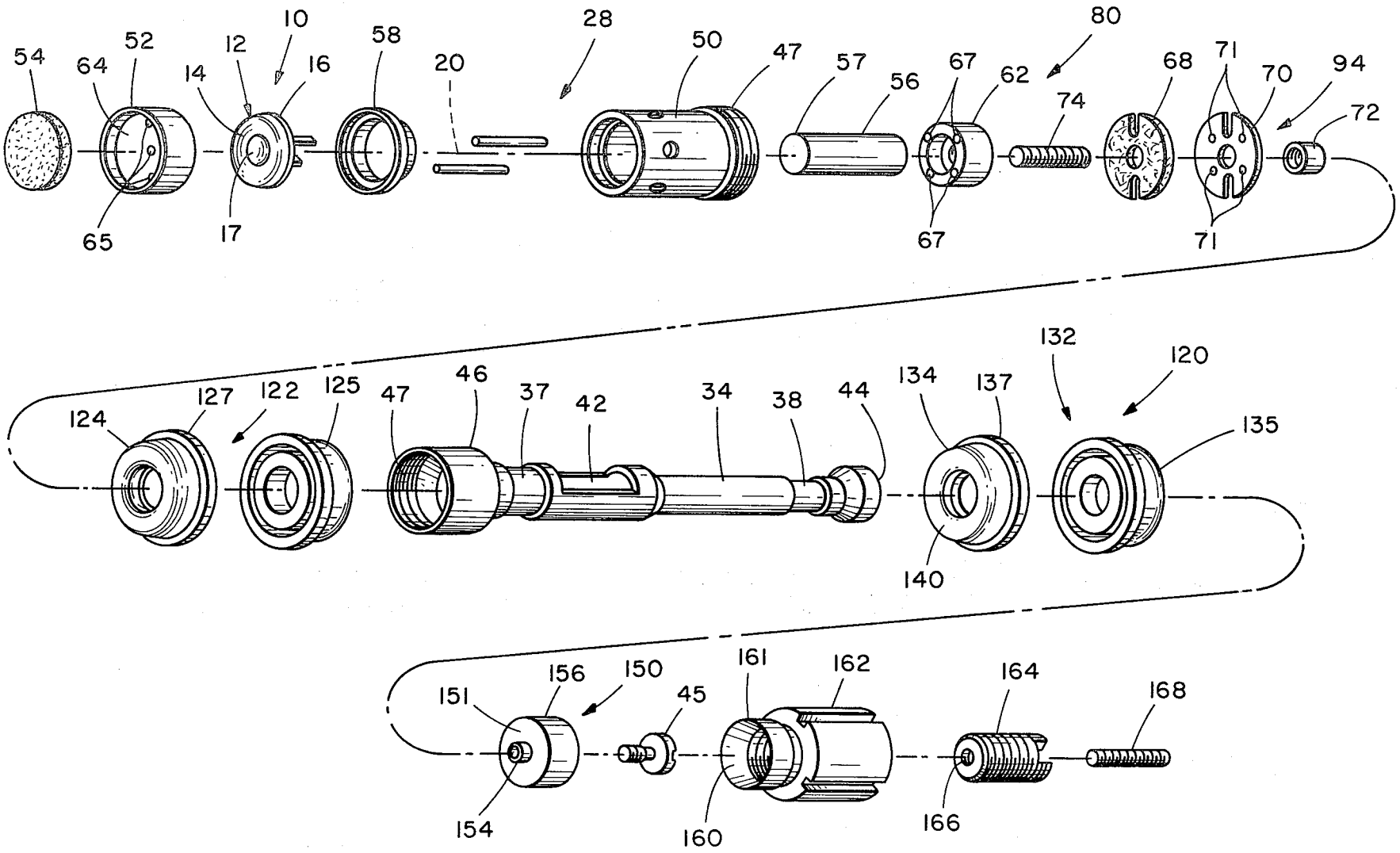
FIG. 3 is an exploded view of the microphone shown in FIG. 2 with the outer casing and wind screen removed.

Magnetic assembly 55 of transducer assembly 28 includes a magnet 56 having a front end which forms an inner cylindrical pole piece 57 (FIG. 3). A tubelike cylindrical outer pole piece 58 is radially spaced from and coaxially aligned with inner pole piece 57. The radial spacing provides an air gap 60 between the outer peripheral surface of the inner pole piece and the inner peripheral surface of the outer pole piece.

At its rearward end, magnet 56 is mounted on a yoke 62. Shell 50 and yoke 62 are fabricated from magnetic material, such as iron, to provide a closed magnetic circuit between the outer pole piece and the rearward end of the magnet. With this arrangement, the entire magnetic circuit is closed except for the radially oriented air gap between the inner and outer pole pieces at the front and of the transducer assembly.

Air gap 60 provides a radially-oriented field in which voice coil 24 is disposed without engaging either of the pole pieces. The voice coil consists of a number of turns of fine wire cemented together to form a short, solid, thin-walled tube which is arranged in the air gap in such a manner that axial movement of the diaphragm and voice coil generates an electromotive force to excite a primary winding of a transformer (not shown) by appropirate electrical interconnections between these elements.

Yoke 62 has a plurality of circularly arranged apertures 67 which are closed at their rearward ends by a felt or cloth washer 68 and backed by a pressure plate 70 having apertures 71 which are slightly smaller in diameter than washer 68. The pressure on plate 70 is controlled and adjusted by a nut 72 which bears against the back side of pressure plate 70 and is threadably engaged on the rearward end of an adjusting screw 74. By turning nut 72, pressure on plate 70, as well as the compaction and acoustic qualities of washer 68, can be adjusted.

Acoustical network 80 has a complex acoustical impedance Z2. Network 80 includes a side entry channel 82 having a resistance RS which progresses through radial openings 84 in shell 50. Acoustical signals entering openings 84 progress axially forward through a plurality of peripheral recesses in the outer surface of the outer pole piece 58 (FIG. 3) and the inner surface of the head piece 52. The acoustic signals progress from these recesses forward to the back surface 15 of diaphragm 12.

Network 80 also incorporates a variable volume cavity 90 consisting of an inner cavity 40 within stem 34 and an outer cavity 92 which surrounds stem 34. Cavity 92 is confined within the microphone by an outer casing 100 and is bounded at its front and rear ends by shock mounts 122 and 132, respectively.

Network 80 also incorporates a rear entry channel 94 (FIG. 3) having a resistance RB which couples cavity 90 to side 15 of diaphragm 12. Channel 94 progresses from side 15 of diaphragm 12 through the cylindrical passage defined by voice coil 24 in the air gap and through a chamber 96 between magnet 56 and shell 50. From chamber 96, channel 94 continues through apertures 67 in yoke 62, felt washer 68 and apertures 71 in pressure plate 70, to cavity 40. Cavity 40, in turn, communicates with cavity 92 through port 42.

Acoustic diaphragm assembly 10, voice coil 24, transducer assembly 28 and acoustical network 80 are enclosed by an outer casing 100 comprising a base 102 which is fixed to a wind screen 106 by threads 104. At the rear end of base 102 may be a cable connector which closes the end of the base and provides for electrical connections to the system that is to receive electrical signals from the microphone.

Outer casing 100 is resiliently coupled to transducer assembly 28 by a mounting assembly 120 having a complex mechanical impedance Z1, and an effective area AM confronting cavity 90.

The mounting assembly 120 comprises a front toroidal shock mount 122 (FIG. 3) having a left-hand section 124 and a right-hand section 125. The left and right-hand sections fit together in order to form an outer perimeter 127 and an inner perimeter 128 which fits into recess 37 of stem 34. A curved inside surface 130 of shock mount 122 is in contact with cavity 92.

Mounting assembly 120 also comprises a rear toroidal shock mount 132 which is identical in form to shock mount 122, but is somewhat smaller in size. Shock mount 132 (FIG. 3) has a left-hand section 134 and a right-hand section 135 that fit together in order to form an outer perimeter 137 and an inner perimeter 138 which fits into recess 38 of stem 34. A curved inside surface 140 of shock mount 132 is in contact with cavity 92. Shock mounts suitable for use in this embodiment are described in more detail in U.S. Pat. No. 3,653,625 (Plice — Apr. 4, 1972). Shock mount 122 must have a larger effective area than shock mount 132 in order to provide the pneumatic pumping action described hereinafter.

Mounting assembly 120 also comprises a mounting diaphragm 150 (FIG. 3) having a front surface 151 and a rear surface 152. A cylindrical mounting lip 154 (FIG. 3) and cylindrical flange 156 are axially displaced from surfaces 151 and 152. Surface 151 confronts an isolation chamber 158 which is vented to the atmosphere in order to prevent undesired second order coupling between cavity 90 and an enclosed air spring chamber 160 which is formed in part by a cylindrical sleeve 161 of a metal fixture 162. The volume of chamber 160 may be controlled by the movement of a threaded plug 164 which is received by fixture 162. Plug 164 embosses its own threads into a slightly undersized hole 166 (FIG. 3) which receives a threaded adjustment screw 168. The spiral space between the threads of screw 168 and hole 166 forms an adjustable length air leak from chamber 160 to the atmosphere. The resistance or viscous damping of the leak can be adjusted by turning screw 168 in order to increase or decrease the length of the path along which the threads of screw 168 are in contact with hole 166.

After the microphone is assembled in the manner shown in the drawings, it is balanced to provide shock cancellation by adjusting plug 164 and screw 168. Plug 164 adjusts the compliance of chamber 160 and screw 168 adjusts the resistance of the air leak from chamber 160 so that the components of the microphone more nearly satisfy the equation:

$$1 + \frac{MT}{MC} = \left(1 + \frac{Z1}{(AM)^2(Z2)}\right) \left(1 + \frac{RS}{RB}\right) \left(\frac{AM}{AD}\right)$$

It should be noted that this is a vector equation, so that $Z1$ and $(AM)^2(Z2)$ must have nearly equal or at least similar phase angles and a nearly constant ratio for the balance criterion to apply. Of course, the components of the microphone should be designed to satisfy the equation without adjustment to the extent this is possible.

The correct adjustment of plug 164 and screw 168 is determined by vibrating the microphone and measuring the output in the frequency range of interest (e.g., typically a range of about 50 to 300 cycles per second). Plug 164 and screw 168 are adjusted until the minimum output is achieved over the frequency range of interest. Moving plug 164 and screw 168 changes the complex impedance of the shock mount assembly so that $$\frac{Z1}{(AM)^2(Z2)}$$

is more nearly constant over the frequency range of interest. In addition, the phase angles of $Z1$ and $(AM)^2(Z2)$ become more nearly equal. This process also reduces the output of the microphone due to axial shock forces. After the microphone is properly adjusted, it reduces the output due to axial shock forces applied to outer casing 100 as follows:

Assuming a shock force is applied to casing 100 in the direction of the arrow F (FIG. 2), casing 100 momentarily moves to the left relative to housing 30, thereby creating a slight pressure in cavity 90. A small percentage of shock force F is coupled to housing 30 through shock mounts 122 an 132 so that transducer assembly 28 tends to move to the left relative to diaphragm 12 and voice coil 24, which are resiliently mounted on transducer assembly 28. This relative movement between transducer assembly 28 and voice coil 24 would normally produce an electrical output from the microphone. However, the pressure in cavity 90 tends to move diaphragm 12 to the left in step with the movement of transducer assembly 28, so that the relative movement between voice coil 24 and transducer assembly 28 is minimized. Pressure from cavity 90 is coupled to side 15 of diaphragm 12 through rear entry channel 94 in the manner previously described in order to keep diaphragm 12 in step with assembly 28.

By using components of the type described and adjusting the components in the manner taught, the output of the microphone due to mechanical shocks applied to casing 100 in a direction parallel to axis 20 may be substantially reduced over a wide range of frequencies. Those skilled in the art will recognize that the preferred embodiment described above may be altered and modified without departing from the true spirit and scope of the invention as defined in the accompanying claims.

What is claimed is:

1. A microphone comprising:

diaphragm means defining a center point, a first side and a second side for vibrating in response to sound waves striking at least the first side, said diaphragm means defining a longitudinal axis perpendicular to a plane tangent to the diaphragm means at the center point and passing through the center point;

transducer means for converting the vibration of the diaphragm means into corresponding electrical signals;

housing means for supporting the diaphragm means in relationship to the transducer means;

means for defining a variable volume cavity;

acoustical channel means for coupling the variable volume cavity to the second side of the diaphragm means so that the diaphragm means is moved in response to any pressure change in the cavity;

an outer casing;

mounting means having at least one adjustable characteristic for resiliently coupling the outer casing to the housing and responsive to a component of force applied to the outer casing in a direction parallel to the longitudinal axis for reducing the tendency of the diaphragm means to move in a first direction in response to the component force by creating a pressure in the cavity which urges the diaphragm means in a second direction opposite the first direction; and adjustment means for adjusting each adjustable characteristic of the mounting means.

2. A microphone, as claimed in claim 1, wherein the adjustable characteristic of the mounting means is compliance.

3. A microphone, as claimed in claim 1, wherein the adjustable characteristic of the mounting means is viscous damping.

4. A microphone, as claimed in claim 1, wherein the adjustable characteristics of the mounting means are compliance and viscous damping.

5. A microphone, as claimed in claim 1, wherein the mounting means comprises:

a mounting diaphragm having a first side and a second side extending between the outer casing and the housing; and an enclosed chamber defined in part by the second side of the mounting diaphragm.

6. A microphone, as claimed in claim 5, wherein the mounting diaphragm is arranged perpendicular to the longitudinal axis.

7. A microphone, as claimed in claim 5, wherein the adjustment means comprises:

means for adjusting the volume of the enclosed chamber; and means for providing an adjustable air leak from the chamber to the atmosphere.

8. A microphone, as claimed in claim 7, wherein the first side of the diaphragm is vented to the atmosphere.

9. A microphone, as claimed in claim 8, wherein the mounting means further comprises:

a first hollow toroid having an inner surface surrounding the housing and an outer surface located in contact with the outer casing; and a second hollow toroid having an inner surface surrounding the housing and an outer surface located in contact with the outer casing, said second toroid being located closer to the diaphragm means than the first toroid.

10. A microphone, as claimed in claim 9, wherein the second toroid has a larger cross-sectional area than the first toroid and wherein the first and second toroids define in part the variable volume cavity.

11. A method of balancing a unidirectional microphone comprising diaphragm means defining a center point, a first side and a second side having an effective area AD for vibrating in response to sound waves striking the first and second sides, said diaphragm means defining a longitudinal axis perpendicular to a plane tangent to the diaphragm means at the center point and passing through the center point; a voice coil having a mass MC suspended on the second side of the diaphragm; transducer means having a mass MT for converting the vibration of the diaphragm means and the voice coil into corresponding electrical signals, said transducer means including a housing for supporting the diaphragm means in relationship to the transducer means; acoustical network means having an acoustical impedance $Z2$ coupled to the second side of the diaphragm means, said acoustical network means comprising a variable volume cavity, a first channel havng a resistance RB for coupling the variable volume cavity to the second side of the diaphragm means and a second channel having a resistance RS for coupling the second side of the diaphragm means to the atmosphere; an outer casing; and mounting means having a complex mechanical impedance $Z1$ and an effective area AM in contact with the variable volume cavity for resiliently coupling the outer casing to the housing and responsive to a component of force applied to the outer casing in a direction parallel to the longitudinal axis for reducing the tendency of the diaphragm means to move in a first direction in response to the component of force by creating a pressure in the variable volume cavity which urges the diaphragm means in a second direction opposite the first direction, said method comprising a process for reducing the sensitivity of the microphone to vibrations within a predetermined range of frequencies including the steps of:

designing the microphone component values to as nearly as possible satisfy the equation:

$$1+\frac{MT}{MC}=\left(1+\frac{Z1}{(AM)^2(Z2)}\right)\left(1+\frac{RS}{RB}\right)\left(\frac{AM}{AD}\right);\text{ and}$$

adjusting impedance $Z1$ relative impedance $(AM)^2(Z2)$ so that the ratio $$\frac{Z1}{(AM)^2(Z2)}$$

remains as nearly constant as possible over the predetermined range of frequencies and so that the phase angle of impedance $Z1$ and the phase angle of impedance $(AM)^2(Z2)$ are as nearly equal as possible, whereby the microphone becomes less sensitive to shock forces applied to the outer casing parallel to the longitudinal axis.

12. A method, as claimed in claim 11, wherein the step of adjusting impedance $Z1$ relative to impedance $(AM)^2(Z2)$ comprises the step of adjusting only impedance $Z1$.

13. A method, as claimed in claim 11, wherein the step of adjusting impedance $Z1$ relative to impedance $(AM)^2(Z2)$ comprises the step of adjusting only the mounting means.

14. A method, as claimed in claim 13, wherein the mounting means comprises a mounting diaphragm having a first side and a second side extending between the outer casing and the housing, and an enclosed chamber defined in part by the second side of the mounting diaphragm, and wherein the step of adjusting impedance Z1 relative to impedance $(AM)^2(Z2)$ comprises the steps of:

adjusting the volume of the enclosed chamber; and adjusting an air leak extending from the enclosed chamber to the atmosphere.

15. A method, as claimed in claim 14, and further comprising the step of venting the first side of the mounting diaphragm to the atmosphere.

* * * * *

UNITED STATES PATENT OFFICE

CERTIFICATE OF CORRECTION

PATENT NO. : 3,989,905

DATED : November 2, 1976

INVENTOR(S) : C. Roger Anderson, Eduard A. Rusch, Charles E. Seeler

It is certified that error appears in the above-identified patent and that said Letters Patent are hereby corrected as shown below:

In the equation in Column 3, line 31, $\frac{RS}{RB}$ should read $\frac{RB}{RS}$; and $\frac{AD}{AM}$ should read $\frac{AM}{AD}$.

In the equations in Column 6, line 40 and Column 9, line 8, in each case, $\frac{RS}{RB}$ should read $\frac{RB}{RS}$.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*